US012345099B2

(12) United States Patent
Violante Ferreira et al.

(10) Patent No.: US 12,345,099 B2
(45) Date of Patent: Jul. 1, 2025

(54) COMPLIANT COMPONENT FOR SUPPORTING BEND STIFFENERS

(71) Applicants: PETRÓLEO BRASILEIRO S.A.—PETROBRAS, Rio de Janeiro (BR); UNIVERSIDADE FEDERAL DO RIO GRANDE DO SUL—UFRGS, Porto Alegre (BR)

(72) Inventors: Claudio Violante Ferreira, Rio de Janeiro (BR); Bruno Pinho Dos Reis, Rio de Janeiro (BR); Rogério José Marczak, Porto Alegre (BR); Jorge Gomes De Melo Medeiros, Rio de Janeiro (BR); Leonel Echer, Porto Alegre (BR); Gilnei Reckziegel, Rio de Janeiro (BR); Jakson Manfredini Vassoler, Porto Alegre (BR); Flávio Barroso De Mello, Rio de Janeiro (BR)

(73) Assignees: PETRÓLEO BRASILEIRO S.A.—PETROBRAS, Rio de Janeiro (BR); UNIVERSIDADE FEDERAL DO RIO GRANDE DO SUL—UFRGS, Porto Alegre (BR)

( * ) Notice: Subject to any disclaimer, the term of this patent is extended or adjusted under 35 U.S.C. 154(b) by 234 days.

(21) Appl. No.: 18/324,774

(22) Filed: May 26, 2023

(65) Prior Publication Data

US 2024/0003197 A1 Jan. 4, 2024

(30) Foreign Application Priority Data

May 30, 2022 (BR) ..... 10 2022 010511 1

(51) Int. Cl.
*E21B 17/01* (2006.01)

(52) U.S. Cl.
CPC ..... *E21B 17/017* (2013.01)

(58) Field of Classification Search
CPC ..... E21B 17/017
See application file for complete search history.

(56) References Cited

U.S. PATENT DOCUMENTS 4,403,658 A 9/1983 Watkins
4,443,130 A * 4/1984 Hall ..... E21B 41/10 294/86.15

(Continued)

FOREIGN PATENT DOCUMENTS

BR 102013019602 A2 10/2015
EP 3 473 801 4/2019

(Continued)

OTHER PUBLICATIONS

Gomes, Sep. 2018, Análise Numérica de Enrijecedor à Flexão para I-tube (Numerical Analysis of Flexure Stiffeners for I-tube), Master's Thesis, Univeridade Federal do Rio de Janeiro, 96 pp.

(Continued)

*Primary Examiner* — Kyle Armstrong
(74) *Attorney, Agent, or Firm* — Knobbe, Martens, Olson & Bear, LLP

(57) ABSTRACT

The present invention comprises a structure with the same external geometry as a generic hook, but with a topology (internal structuring) that allows a greater distribution of deformation energy to all elements of the part, with load transfer to other less stressed regions. When the present invention is subjected to a loading, said flexible parts deform in a pre-specified manner, transferring part of a loading that would be excessive in a given region to another less loaded region, without any power supply or external interference. In this way, the deformation pattern that occurs in the present invention relieves stresses where they are greatest and, at the (Continued)

A

B same time, provides flexibility (compliance), more adequately distributing coupling loads between the various fastening components.

4 Claims, 4 Drawing Sheets

(56) References Cited

U.S. PATENT DOCUMENTS

| | | | | |
|---|---|---|---|---|
| 4,808,034 | A | 2/1989 | Birch | |
| 5,318,385 | A | 6/1994 | Goulart | |
| 5,947,642 | A | 9/1999 | Teixeira | |
| 6,799,124 | B2 | 9/2004 | Perdue et al. | |
| 7,069,958 | B2 | 7/2006 | Filho | |
| 7,387,469 | B2 | 6/2008 | Duggan | |
| 7,467,914 | B2 | 12/2008 | Finn | |
| 8,939,214 | B2 * | 1/2015 | Litherland | E21B 43/0107 166/346 |
| 9,163,463 | B2 | 10/2015 | Smith | |
| 9,482,061 | B2 | 11/2016 | Latimer | |
| 9,587,446 | B2 | 3/2017 | Teichmiller | |
| 9,988,860 | B2 | 6/2018 | Salem | |
| 2005/0123358 | A1 | 6/2005 | Blakseth et al. | |
| 2012/0168172 | A1 * | 7/2012 | Litherland | E21B 43/0107 285/314 |
| 2014/0212221 | A1 * | 7/2014 | Routeau | E21B 43/0107 29/505 |
| 2018/0313172 | A1 * | 11/2018 | Smits | E21B 19/004 |
| 2024/0035344 | A1 | 2/2024 | Barroso De Mello et al. | |

FOREIGN PATENT DOCUMENTS

| | | |
|---|---|---|
| GB | 2291686 | 1/1996 |
| WO | WO 2019/232605 | 12/2019 |
| WO | WO 2020/058710 | 3/2020 |

OTHER PUBLICATIONS

Schimidt, Felippe, 2016, Instalação de linhas flexíveis e umbilicais: testes de condicionamento e falhas operacionais (Installation of flexible lines and umbilicals: conditioning tests and operational failures), Master Thesis, Universidade Federal Fluminense.

* cited by examiner

COMPLIANT COMPONENT FOR SUPPORTING BEND STIFFENERS

FIELD OF THE INVENTION

The present invention pertains to the field of technologies related to oil exploration. More specifically, a device for fastening the helmet of the Stiffeners (Bend Stiffeners) to the Bell Mouths to support the loads of Flexure and Shear Strength of risers and umbilicals.

BACKGROUND OF THE ART

The DOGs are crucial components that integrate the support system of the Stiffeners (Bend Stiffeners) to Bell Mouths to support the loads of Flexure and Shear Strength, acting as hooks to support the Stiffener Helmet, as can be seen in FIG. 1.

This type of support is widely used in oil extraction in ultra-deep waters. During the support of the Bend Stiffener, the DOGs ensure the support of the Helmet & Stiffener set; more specifically, for the ring and the DOG holder plates, allowing the transmission of the Bending Moment and Shearing Strength by the Helmet to the structure of the Bell Mouth. In this way, the structural efficiency of DOGs is essential to ensure the correct coupling and support of flexible risers in flexure loads.

FIG. 1 illustrates the characteristic shape, the usual solution in these cases, of a DOG as used in the concepts of Bell Mouths.

The curvature on the support face of the DOG acts as a bed to support the coupling structure, called the Stiffener Helmet, as illustrated in FIG. 1.

On several occasions, these components failed completely well before the designed end-of-life period.

Investigations of events that occurred on some Petrobras and chartered platforms indicated, for the most part, that the failure of the DOGs occurred due to fatigue, with the complete fracture occurring in the region of curvature between the body of the DOG and the face that supports the Stiffener Helmet, as can be seen in FIG. 2. With this, it is inferred that, since the component may present nonconformities in relation to the characteristics defined in the design, these foster the appearance of imperfections that will be the prelude to serious structural failures that manifest as the fracture of the DOGs.

In general, the process initially occurs with the nucleation of cracks, which, under a state of high structural stress in the curvature region of the DOG, as well as its lack of flexibility, favor the appearance of cracks that evolve to the brittle failure stage, leading to the collapse of the components. This situation is undesirable, generating a series of losses, whether operational or economic, such as inoperative bell mouths, maintenance stoppages, loss of profit due to a decrease in production volume, use of divers to replace components, among others.

For the dimensioning of the DOGs, these are considered as subcomponents of the Bell Mouth, and must be dimensioned together using the strengths from the riser. FIG. 3 shows a representation of these strengths, through a simplified free-body diagram of the flexible riser in the vicinity of the SPU (Stationary Production Unit). As the Bend Stiffener is locked in the Bell Mouth by the DOGs, the lateral loads from the riser tension (T) are transferred in the form of shear strength (C) and bending moment (M) to the support in a position below the water line. These strengths are evaluated at the Stiffener Work point, denoted in FIG. 3 by p0. Due to the lack of longitudinal locking of the riser with the Stiffener, the riser is deflected and realigned, establishing a vertical extension between the Bell Mouth and the Hang-Off. In this way, the tension of the riser (H), without curvatures, is anchored in the Hang-Off.

Typically, the DOGs are designed with high rigidity to withstand a critical load scenario in which, as previously mentioned, there has not been shown the failure factor of these components.

A preliminary solution used for the problem of failure of DOGs was to reinforce the geometry of this component; however, this method did not show much effectiveness.

In this way, an assessment was made of the nature of the stresses acting on these components, aiming at finding the reason for presenting a high failure rate due to fatigue, but not due to a collapse (extreme load).

FIG. 3 presents the strengths that the riser transfers to the Bend Stiffener, which are the shear "C" and the bending moment "M" (already presented earlier), detailing how they are transmitted to the DOGS and the Bell Mouth. It is observed that the loads acting on the Bend Stiffener, and consequently on the Bell Mouth, are mostly oriented in the transverse direction. Thus, the main reaction strengths (primary stresses), Ra and Rb, commonly known as the Bell Mouth reaction torque, are the main loadings acting on the structure, which can cause both its collapse due to overload and failure of the structure due to fatigue.

Thus, disregarding the Bend Stiffener's own weight, which is negligible in relation to the reaction torque, no other expressive strength is applied in the longitudinal direction of the Bell Mouth.

However, due to the gap between the Bend Stiffener Helmet and the Bell Mouth and the elastic deformations of the structures, a relative rotation occurs between these two components, causing an imposed displacement of the Bend Stiffener helmet on the DOG positioned in the direction opposite to the direction of the riser top strengths. As a reaction to the imposed displacement, a "u" reaction strength arises on the DOG, which, due to its stress nature (imposed displacement), can be considered a secondary reaction. That is, the probability of DOG failure due to critical load is quite low; however, the fatigue stresses may be significant.

The secondary reaction behavior was identified for the first time during a structural analysis with the objective of verifying the influence of the failure of the DOGs on the overall behavior of the Bell Mouth, in which the absence of the three most stressed DOGs was considered.

Evidently, due to the inefficient support of the Stiffener, there was found an increase in the level of stresses in Bell Mouth. However, even with the absence of the most stressed DOGs, the position of the Bend Stiffener Helmet inside the Bell Mouth was not significantly altered, and the Helmet was still sufficiently contained in its predicted operating position. This result confirmed that the reaction in the DOG is not essential to oppose the operational loads of the riser, thus characterizing a secondary reaction.

Based on the results obtained in this preliminary structural analysis, the concept of compliant DOGs emerged, in which it was shown that, if the DOG had a certain flexibility that allowed the attenuation of the secondary reaction "u", or the conformation to this displacement, then the stress acting on the DOGs would be reduced, thus increasing their fatigue life. This evidence becomes clearer through the graph in FIG. 4, which presents an overview of the behavior of the Compliant DOG as a function of its theoretical stiffness, in which the DOG is evaluated as a spring element with stiffness "k" positioned between the DOG holder plate of the Bell Mouth (Position "X" of FIG. 1) and the region of the Helmut in which the displacement "u" of FIG. 4 is applied. Two results are shown in the graph of FIG. 4: the characteristic stress of fatigue in the critical region (center of curvature shown in FIG. 2, identified by region XV) of the DOG (left scale)—reference stress for the fatigue calculation, and the maximum resulting displacement of the DOG (right scale). The reference values, represented by lines with constant value in the graph, indicate the results obtained considering the current Bell Mouth design (DOGs without the compliant system).

The behavior shown in FIG. 4 indicates that the compliant DOGs system acts as supposed during its conceptual development; that is, the stress acting on the DOG has an inverse proportionality relationship to its stiffness. As for the results of displacements, the behavior obtained is more trivial, being evident that larger displacements will be observed for lower stiffness values.

These two results indicate a duality that must be respected in the detailed design of the compliant DOG; that is, this component must be flexible enough to reduce the secondary strengths to which it is subjected; however, it must also present a satisfactorily high rigidity so that its displacement is compatible with the design space of the Bell Mouth.

Conceptually, the design demonstrates that there is a DOG configuration that supports the workloads through an appropriate deformation mechanism, but this configuration is not obtained through a massive DOG, as typically adopted in Bell Mouths.

The combination of flexibility and mechanical strength of the DOG was obtained by removing material both inside the body and in its lower region, thus modifying the geometric concept and the way in which the component responds to external excitations compared to a typical massive DOG, as illustrated in FIG. 2. With this, there are obtained the amplification of displacements and the consequent drop in stress peaks, in addition to minimally modifying the external design of the DOGs, in order to take advantage of the other already-built components in the best possible way.

Furthermore, a geometry concept was also used that mimics the behavior of a Compliant Mechanism (CM), based on compliance strategies for displacement inverter mechanisms, force amplifiers, and Origami-type structures. This type of geometric alteration causes the DOG to act similarly to a mechanism and no longer as a conventional structure. This can be visualized in the way the flexure of internal members to the component form coupling pairs, and thus the displacement is amplified at the same time that the lower half of the DOG moves as a whole. Compliant DOGs' behavior ensures more flexibility without compromising their strength and purpose; that is, support exerted by the component in forming a support bed for the Bend Stiffener Helmet.

Upon applying these strategies to the original geometry of the DOGs, a concept was reached in which the upper end of the DOG curvature is physically separated from the anterior face, as illustrated by FIG. 5. Furthermore, the support face contains a curved element (bending member) that extends through the lower region of the DOG and acts up to the initial part of its body. This curved element acts by generating locking points with rods connected to the anterior and posterior faces of the DOG. With this, a component is obtained that will always have iteration of all external walls to support load, regardless of the loading direction. This is crucial to ensure that the DOG operates correctly not only when in normal operation, but also in coupling (pull-in) and decoupling (pull-out) situations with the Bell Mouth (Bend Stiffener Helmet) structure.

The results found in the simulations to validate this concept showed the potential that the use of compliant DOGs geometries can bring in terms of mechanical efficiency for the support system. The proposed concept was able to significantly reduce the maximum stress peaks acting in the critical regions of the DOGs; that is, support and curvature faces. This implies a direct and expressive gain in fatigue life, something crucial for the adverse environment in which these components operate.

Furthermore, in a direct comparison with the original concepts, the stress distribution in the proposed concepts extended over a larger region along the body of the DOGs, resulting in components with greater efficiency in the distribution of internal strengths.

In addition, the gain in terms of reduction of stress acting on the DOGs, conferred by the concept of compliance, was reflected in the estimated fatigue life, where the performance was much superior to the original DOGs currently employed.

As an alternative to the previously described solution, the compliant system can be obtained by changing the stiffness of another component of the Bell Mouth, such as the DOG axis (indication "IX" in FIG. 1).

Furthermore, the present invention provides the following advantages: less downtime for maintenance and repairs due to failures in the DOGs and, consequently, the support system as a whole; weight reduction, resulting in cascading cost reduction (less material, lighter for transport and installation, easier handling); as they have a high fatigue life, the use of compliant components implies a drastic reduction in the need for intervention for repairs/replacements by means of divers; fatigue life high enough to fit the design criteria practiced by companies in the oil and gas field; the couplings by compliance system provide more safety throughout its useful life, as these components are naturally more reliable than couplings by moving parts.

STATE OF THE ART

Document U.S. Pat. No. 6,799,124B2 discloses a coupling system between a Bend Stiffener and a Bell Mouth, comprising a plurality of locking mechanisms, wherein each locking mechanism is externally fastened to the Bell Mouth and comprises a movable tongue, positioned inclined downwards, where the tongue accesses the interior of the Bell Mouth and is driven by an elastic element adapted to exert pressure on the tongue towards the interior of the Bell Mouth.

Said document U.S. Pat. No. 6,799,124B2 does not disclose or describe any modification in the body of the DOG to provide compliance to the same, in order to mitigate fatigue damage to the component.

The document "Análise Numérica de Enrijecedor à Flexão para I-tube" (Numerical Analysis of Flexure Stiffeners for I-tube), Gustavo Alves Pinto Mosqueira Gomes.—Rio de Janeiro: UFRJ/COPPE, 2018, addresses to an evaluation of the behavior of the riser when it is subjected to a certain axial load with an established rotation angle. At work, finite element models were developed to verify the differences between the traditional coupled configuration, which considers the riser and the Bend Stiffener crimped in the same position, and the I-tube configuration, which considers a significant length of flexible pipe above the Bend Stiffener and different crimping positions. In addition, the gap between the pipeline and the Bend Stiffener, which is normally disregarded in the analyses, was also evaluated.

The document SCHIMIDT, FELIPPE & Fortes, Marcio & Silva, Agnaldo (2016) "Instalação de linhas flexíveis e umbilicais: testes de condicionamento e falhas operacionais" (Installation of flexible lines and umbilicals: conditioning tests and operational failures) discloses the features and components of flexible lines and umbilicals, highlighting the steps and types of scope of installation. In addition, it describes the tests carried out on the launch ship for validation and conditioning of the flexible and umbilical line for operation in the offshore field.

Document BR102013019602A2 addresses to an accessory provided to the top termination of the riser, capable of allowing a certain rotation around the axial axis of the riser and, consequently, changing the horizontal angle of projection of said riser, reducing strengths in the attachment structures and their supports on the platform. Consequently, it allows chain cost reductions, from design to supply, of all components involved in attaching the end of the riser to the platform. Alternatively, the accessory is capable of providing flexibility in the angle of entry of the risers in relation to the platform, obtaining arrangements with shorter lengths of pipelines on the seabed, avoiding interference or geographic impediments on the seabed.

The documents "Análise Numérica de Enrijecedor à Flexão para I-tube" (Numerical Analysis of Flexure Stiffener for I-tube), "Instalação de linhas flexíveis e umbilicais: testes de condicionamento e falhas operacionais" (Installation of flexible lines and umbilicals: conditioning tests and operational failures) and the application BR102013019602A2 describe only Bend Stiffener support systems with single component DOGs and without indicating any modification in the body of DOGs, in order to increase their fatigue strength.

It is noted that the present invention maintains the original external geometry of the commonly used DOGs, removing internal material without changing the composition of the steel, maintaining its functional specification in accordance with the cited documents.

Accordingly, it is evident that although changes in geometry improve the fatigue life of a part, the change proposed in the present invention would not be obtained by a technician skilled on the subject in a trivial way from the State of the Art.

BRIEF DESCRIPTION OF THE INVENTION

Due to the nature of the loadings involved in the support process, the DOGs must have characteristics of high strength/rigidity to ensure the coupling and sufficient flexibility to allow the absorption of strengths arising from the kinematic movements of the coupling. These characteristics are rarely obtained concomitantly, so that, in recent decades, critical failures of DOGs have prematurely occurred.

The present invention comprises a component similar to a conventional DOG, equipped with a structural mechanism formed by a more flexible optimized geometry, which ensure flexibility to the component as a whole. When the present invention is subjected to a loading, said flexible parts deform in a pre-specified manner, transferring part of a loading that would be excessive in a given region to another less loaded region, without any power supply or external interference. In this way, the deformation pattern that occurs in the present invention alleviates the stresses where they are highest and at the same time provides flexibility (compliance), more adequately distributing the coupling loads between the various DOGs.

BRIEF DESCRIPTION OF FIGURES

In order to obtain a better understanding of the features of the present invention and, according to a preferential practical embodiment of this invention, following to the description there is attached a set of drawings where, in an exemplified way, although not limiting, its operation is represented:

In FIG. 1, there are: (I) Flexible riser top connector, (II) Flexible riser, (III) Lower riser counter, (IV) I-tube, (V) Bell Mouth, (VI) Stiffener (Bend Stiffener), (VII) Bend Stiffener Helmet, (VIII) DOG, (IX) Axis, (X) Ring and Dog Holder Plates;

In FIG. 2, there are: (I) Hole for coupling the locking system, (II) Hole for coupling the support shaft, (III) Posterior face, (IV) Anterior face, (V) Heel, (VI) Lower face, (VII) Center of curvature, (VIII) Support face, (IX) Coupling region, (X) Locking region, (XI) Body, (XII) Heel, (XIII) Lower region, (XIV) Curvature region, (XV) Support face region;

DETAILED DESCRIPTION OF THE INVENTION

Figure 1:
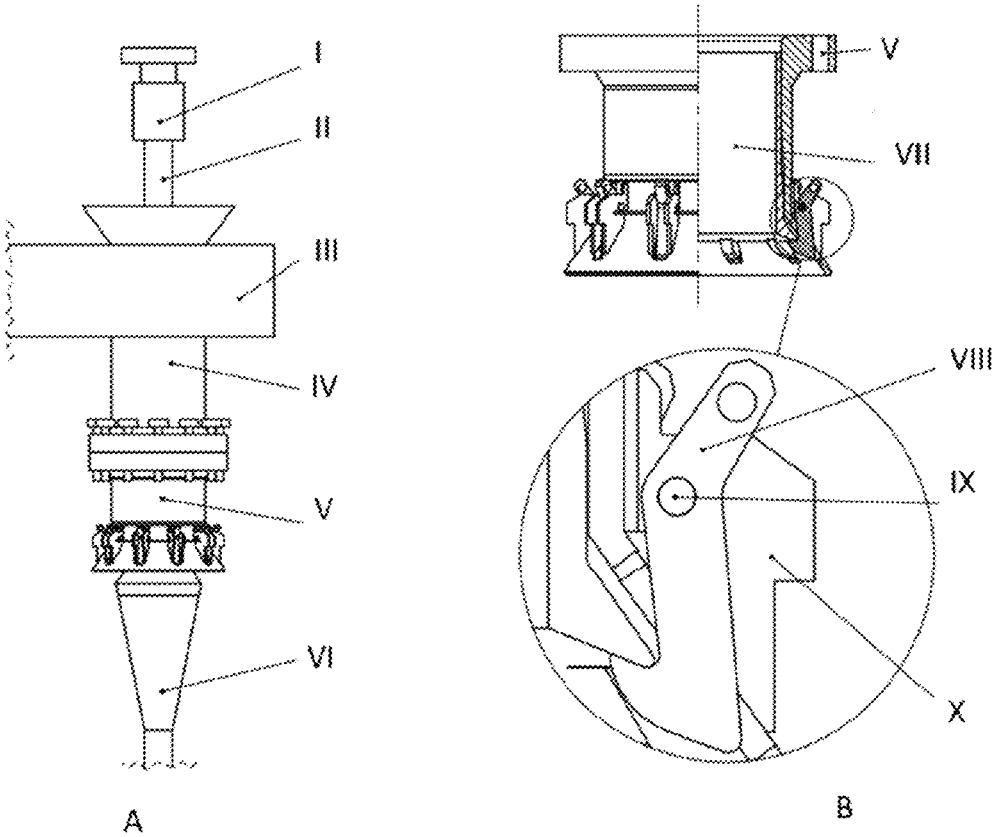
FIG. 1 shows a current usual approach of the components involved in the flexible riser support system (BSN-900E), where there are indicated: (A) components coupled for operation; (B) Detailing for the components of the Bell Mouth.
Figure 2:
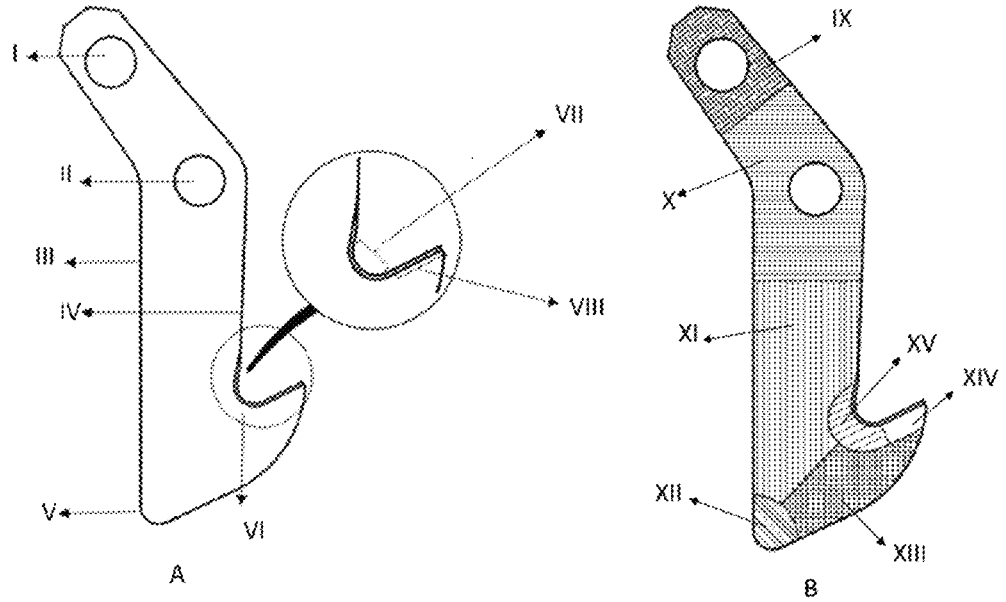
FIG. 2 shows a representation of the different regions that make up a DOG, currently used in the BSN-900.
Figure 3:
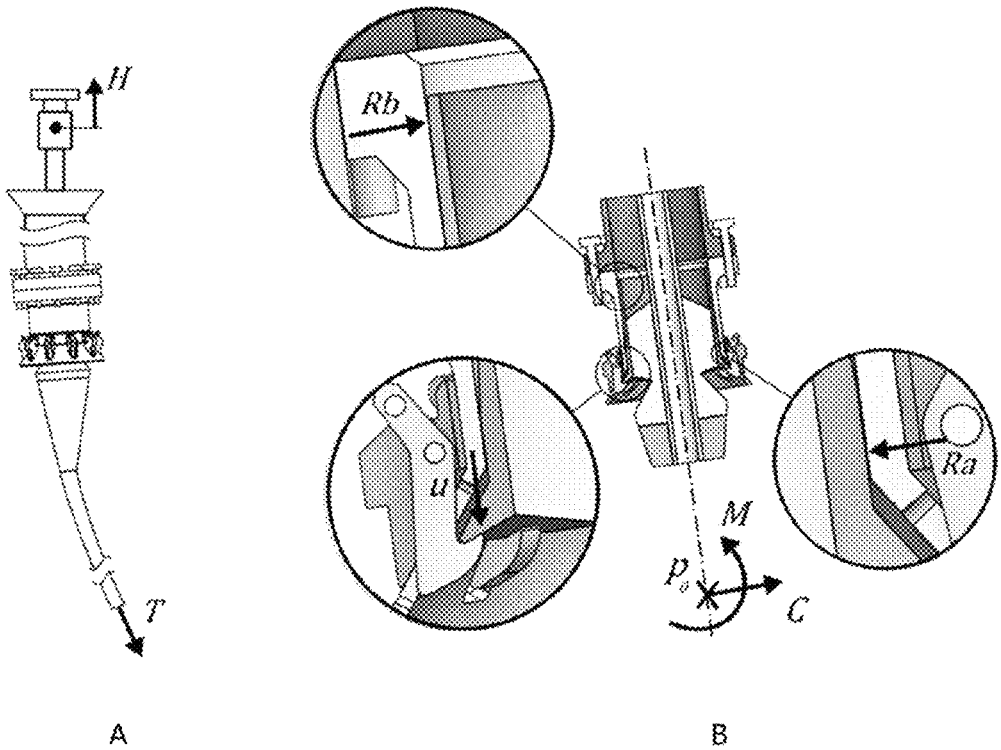
FIG. 3 shows a simplified representation of the acting forces normally used for dimensioning the DOGs, where there are indicated: (A) loading (T) and global reaction (H); (B) distribution of strengths in the support system as a bending moment M and a shear C.
Figure 4:
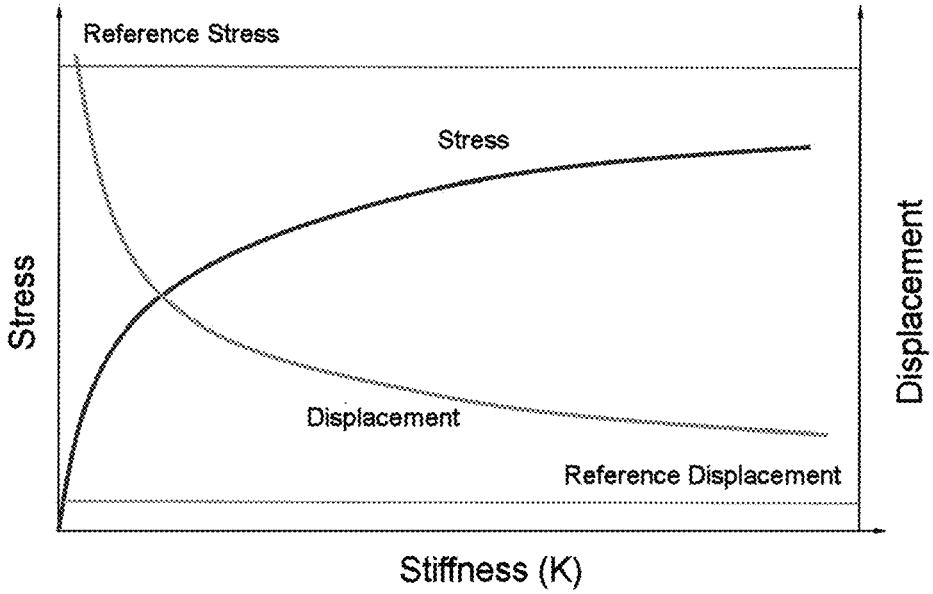
FIG. 4 shows the graph of the result of the preliminary study of the increase in flexibility in the assembly of DOGs, showing the reduction in the level of characteristic fatigue stress.
Figure 5:
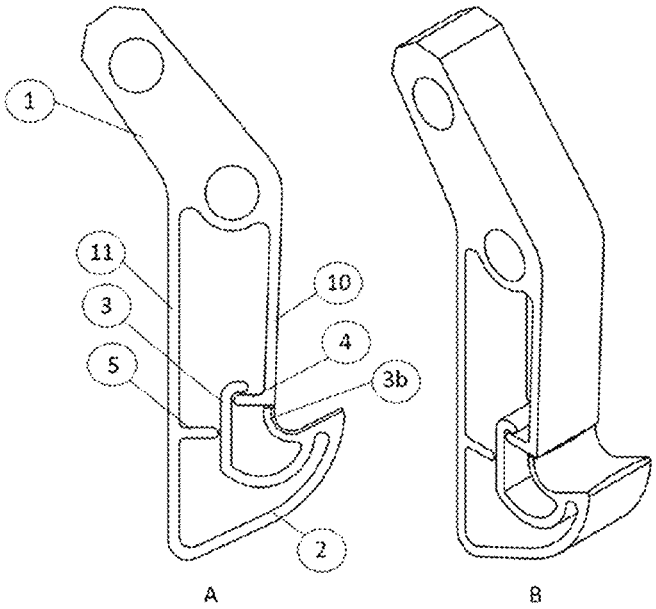
FIG. 5 shows the present invention in one of its preferred configurations based on Compliant Mechanism (CM) for bell mouths, considering the BSN900E model, where: (A) frontal view and (B) isometric view.
Figure 6:
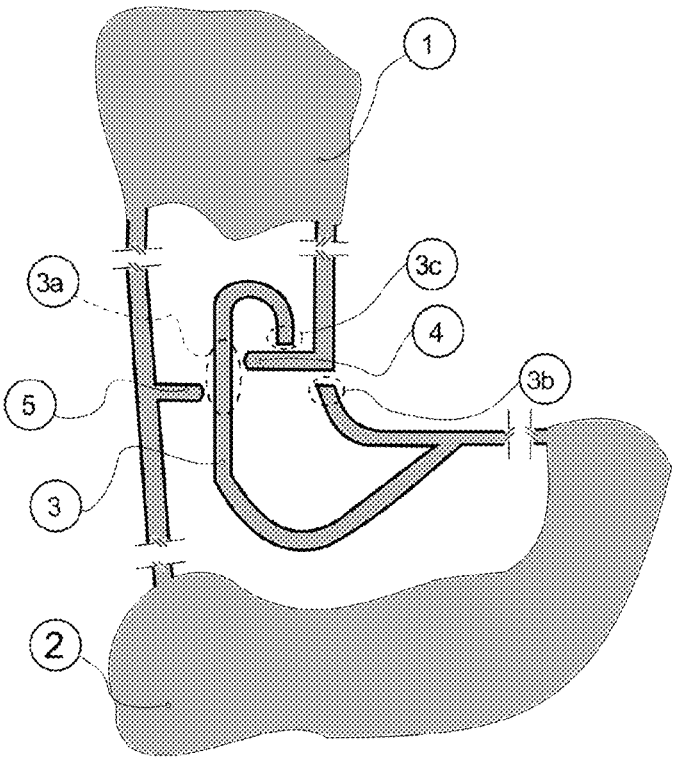
FIG. 6 shows the side view of the present invention in its preferred configuration emphasizing the Compliant Mechanism (CM)

With reference to FIGS. 5, 6, 7, and 8, the present invention comprises, in its preferred configuration, a non-massive component with at least an upper portion (1), a lower portion (2), a compliant member (3), an opening end (**3*b*), an anterior contact rod (4), a posterior contact rod (5), and wherein the upper portion (1) and the lower portion (2) are connected by at least one anterior element (10) and at least one posterior element (11**).

The upper portion (1) preferably consists of a preferably massive region with at least one through hole and/or blind hole, or elements for fastening. The central region, where the compliant mechanism is located, and the lower portion (2) comprise hollow spaces in order to allow the movement of the compliant members (3).

In addition, the upper (1) and lower (2) portions may have geometric variations such as different shapes and/or curvatures to suit different fastenings, provided that they maintain the central portion of the compliant component substantially similar to the preferred presented shape.

The compliant member (3) comprises a curved extension that projects from the top of the lower portion (2) to the central region, located between the anterior (4) and posterior rods (5). Said member (3) comprises a displacement restriction region (3*a*), which is positioned between the anterior (4) and posterior (5) rods, an opening end (3*b*), located immediately below the discontinuity of the anterior face (10), and a locking end (3*c*), located above the anterior rod (4).

Figure 7:
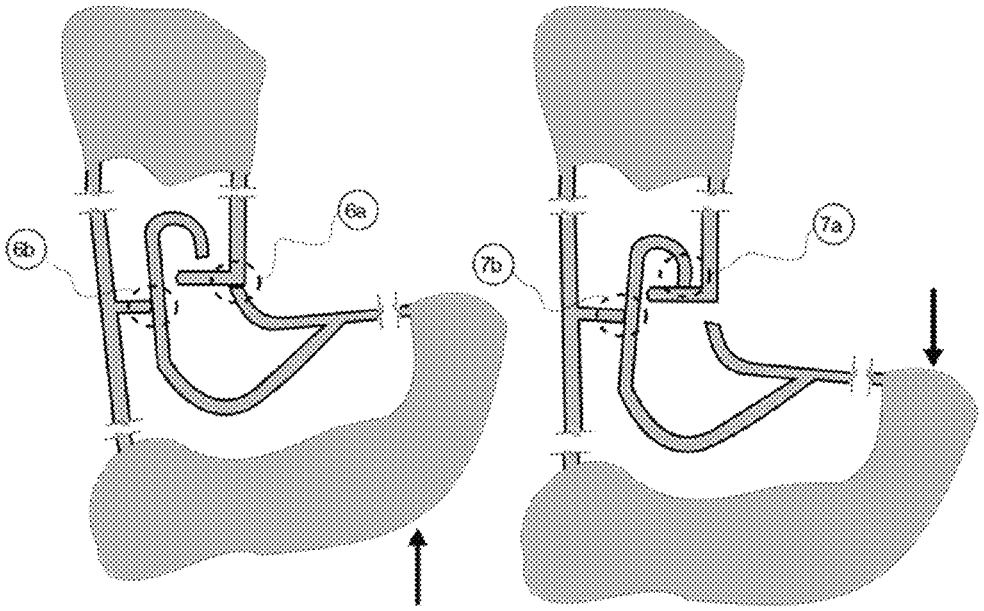
FIG. 7 shows the side view of the present invention, representing the operation of the Compliant Mechanism (CM) under reverse (left) and normal (right) vertical strengths.
Figure 8:
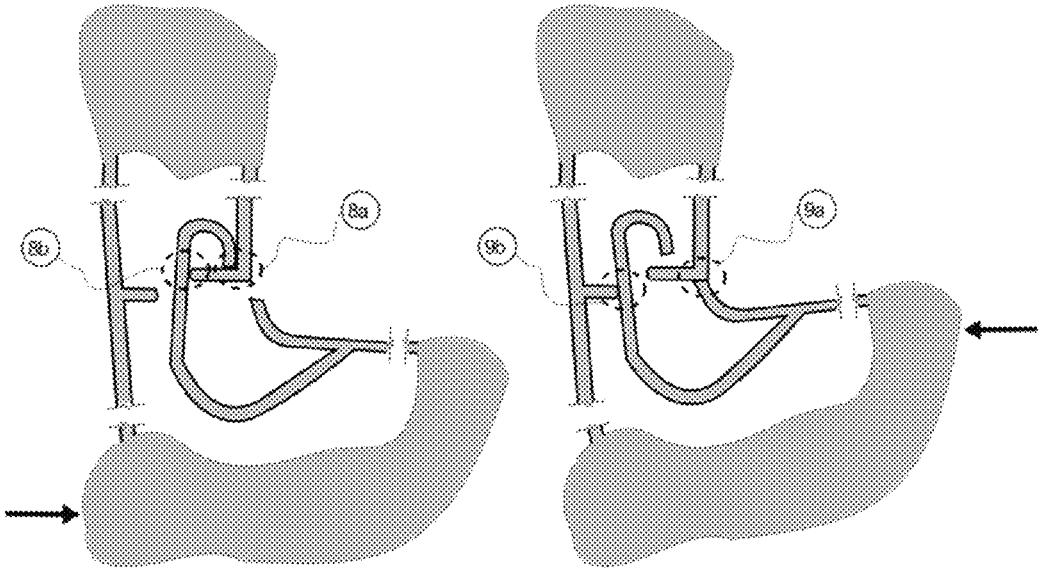
FIG. 8 shows the side view of the present invention, representing the operation of the Compliant Mechanism (CM) under reverse (left) and normal (right) horizontal strengths.

The anterior rod (4) and the posterior rod (5) comprise extensions that depart from the anterior (10) and posterior (11) element, respectively. The anterior element (10) presents a discontinuity in the upper portion of the opening end (3*b*), which allows a great amplification of the movement imposed by the Helmet on the support face of the DOG, as can be seen in FIGS. 7 and 8.

However, when this movement occurs, the curved element acting internally to the DOG, called the compliant member (3), causes the couplings with the faces of the anterior (10) and posterior elements (11) to redistribute the mechanical strength. This redistribution occurs through communication between the contact rods, anterior (4) or posterior (5), with the displacement restriction region (3*a*). Thus, a highly efficient component is obtained, where the amount of material supporting deformation energy is maximized; that is, the compliant member redistributes the displacement effect to previously non-stressed regions.

It is important to note that all internal elements were defined with the same thickness. As a result, homogeneity was maintained between external walls and internal elements. This thickness must be defined as a function of the maximum static strength acting in the form of a critical loading, as well as the fatigue stresses. For the case of DOGs, the possibility of corrosion due to environmental exposure must also be taken into account, and the selection of corrosion-resistant materials or the definition of corrosion over-thickness must be considered.

Considering that the upper portion of the DOG (1) operates under displacement restrictions, while the lower portion of the DOG (2) is subject to strengths from the Stiffener Helmet, there is a combination with four possible displacement directions for the lower portion of the DOG. Obviously, the combination of two or more directions of action of these strengths is possible. By way of illustration, only the four alternatives illustrated in FIGS. 7 and 8 will be discussed here.

Thus, considering a strength acting in the vertical direction and starting from the lower portion (2) to the upper portion (1), there is locking of the compliant system in the curvature region (6*a*) and at the end of the posterior internal rod (6*b*). As this movement is the opposite of that expected for the DOG under operating conditions, it is defined that these locks occur by so-called "reverse" movements. When considering the same strength, but now in the opposite direction, that is, from the upper portion (1) to the lower portion (2), there is an upper internal locking (7*a*) at the free end of the compliant member (3), at the same time that there is a posterior internal locking (7*b*). As this direction of strength is the one normally supported by DOGs, these locks are defined as coming from "normal" strengths. Considering a longitudinal strength starting from the posterior face (11) towards the anterior face (10), a movement of translation/rotation occurs towards the body of the Bell Mouth. As a result, the compliant system is locked by the internal wall (8*a*) at the free end of the compliant member (3*c*), while the anterior internal locking (8*b*) occurs in the restriction region (3*a*).

Now assuming the longitudinal strength in the opposite direction, moving the lower portion of the DOG towards the opposite direction of the Bell Mouth, the locking of the compliant system occurs by closing the line of discontinuity at the end of the curvature of the DOG (9*a*) and with a repetition of the posterior internal locking movement (9*b*).

Depending on the magnitude and direction of action of the strengths, one or more locking regions may occur. During an operational loading, therefore, locking regions can migrate from one region to another along the structure of the compliant member (3).

Thus, the deformation mechanism of this invention allows the support of all types of strengths required in couplings of this type and similar, avoiding high stress concentrations that occur in conventional solutions. This versatility is precisely what makes the compliant DOG so efficient in redistributing strengths to non-stressed regions and providing greater structural flexibility.

Structurally, the present invention proposes a structural mechanism formed by individually more flexible parts than a massive DOG. But when under loading, these parts deform in a pre-specified way, transferring part of a loading that would be excessive in a given region to another less loaded region. This occurs by the action of the external load itself, using the component deformation, without any external power supply or interference. It is this pattern of deformation that relieves stresses where they are greatest and at the same time provides the flexibility (compliance) that best divides coupling loads between the various DOGs.

Thus, essentially, the present invention relies on a structure with the same external geometry of a generic hook, but with a topology (internal structuring) that allows greater deformation of the part with load transfer to other less stressed regions.

The movement conformation strategy to maximize the displacement on the support face and minimize the stresses acting in the critical regions (curvature) of the DOG makes this type of component applicable to any operations/structures that make use of acting components in a gripping position ("hook" type) coupling different components in specific positions/configurations. Among the possible fields of application, there can be mentioned:

1—Extremities of structures for lifting loads for mining;
2—Lifting systems used in the airport environment and in the civil construction sector;
3—Anchoring spikes for structures subject to wind loads;
4—Any and all systems that require high mechanical strength to support weight/load, while at the same time presenting high flexibility to conform to considerable displacement and/or force strengths.

Due to the ability to conform to displacements of considerable magnitude with material distribution absorbing a greater amount of deformation energy, the concept of compliant DOG can be extended to applications that combine the needs of high mechanical strength with high flexibility to meet cyclic prescribed displacement requirements.

Accordingly, those skilled in the art will value the knowledge presented herein and will be able to reproduce the invention in the presented embodiments in other variants, encompassed in the scope of the attached claims.

The invention claimed is:

1. A compliant component for supporting bend stiffeners, comprising:

an upper portion;

a lower portion;

an anterior element and a posterior element connecting the upper portion and the lower portion;

an anterior contact rod extending from the anterior element toward the posterior element;

a posterior contact rod which extends from the posterior element toward the anterior element;

a compliant member comprising a curved extension projecting from a top of the lower portion to a central region located between the anterior and posterior contact rods, the curved extension comprising:

a displacement restriction region positioned between the anterior and posterior contact rods;

an opening end positioned below a discontinuity of an anterior face; and a locking end positioned above the anterior contact rod.

2. The compliant component of claim 1, wherein the upper portion comprises a massive region comprising one or more of a through hole, a blind hole, an element for fastening in a riser support system.

3. The compliant component of claim 1, wherein a central region and the lower portion comprises one or more hollow spaces to allow for movement of the compliant member.

4. The compliant component of claim 1, wherein the upper portion and the lower portion are configured to fasten to a Bell Mouth.

* * * * *